US006659000B1

(12) United States Patent
Wittmaier

(10) Patent No.: US 6,659,000 B1
(45) Date of Patent: Dec. 9, 2003

(54) ROTARY EMBOSSING MACHINE

(75) Inventor: Klaus Wittmaier, Vaihingen/Enz (DE)

(73) Assignee: Schober GmbH Werkzeug-und Mochinenbau, Eberdingen (DE)

( * ) Notice: Subject to any disclaimer, the term of this patent is extended or adjusted under 35 U.S.C. 154(b) by 8 days.

(21) Appl. No.: 10/129,369

(22) PCT Filed: Aug. 1, 2000

(86) PCT No.: PCT/EP00/07429

§ 371 (c)(1),
(2), (4) Date: May 3, 2002

(87) PCT Pub. No.: WO01/34395

PCT Pub. Date: May 17, 2001

(30) Foreign Application Priority Data

Nov. 9, 1999 (DE) ..... 199 53 724

(51) Int. Cl.[7] ..... B44C 1/14; B41F 19/06
(52) U.S. Cl. ..... 101/23; 101/25; 101/27
(58) Field of Search ..... 101/3.1, 22, 23, 101/25, 27, 28, 31, 32, 4, 5, 6, 8, 9

(56) References Cited

U.S. PATENT DOCUMENTS 3,721,185 A * 3/1973 Rambausek ..... 101/25
5,611,272 A * 3/1997 Steuer ..... 101/23

FOREIGN PATENT DOCUMENTS

| | | |
|---|---|---|
| DE | 27 29 538 | 1/1979 |
| DE | 31 49 950 | 7/1983 |
| DE | 37 13 666 | 11/1988 |
| JP | 0040270660 | 9/1992 |
| WO | WO 98/12051 | 3/1998 |

* cited by examiner

*Primary Examiner*—Leslie J. Evanisko
(74) *Attorney, Agent, or Firm*—Paul Vincent

(57) ABSTRACT

A rotary embossing machine applies an embossing sheet section on a web of material. The rotary embossing machine comprises an embossing device and a counter-pressure cylinder. The embossing device is provided with an embossing element and the embossing element with a supply roll for the embossing sheet, a transport device and an embossing tool.

24 Claims, 4 Drawing Sheets

ROTARY EMBOSSING MACHINE

Rotary embossing machines of this type are known e.g. from the following documents: U.S. Pat. No. 5,486,254, WO 98 12 051 A1, DE 196 25 064 A1, DE 37 13 666 A1, EP 0 718 099 A2, EP 0 437 794 A2, DE 37 18 048 A1, DE 90 04 865 U1.

The invention concerns a rotary embossing machine in accordance with the features of the indepenent claim.

BACKGROUND OF THE INVENTION

These rotary embossing machines are used to apply embossing sheet sections onto an endless material web. The embossing sheet sections are sections of a heat-sealing sheet having structured or smooth surfaces and can also have a hologram and a thermally activatable fusion adhesive on the rear side. During application thereof, the embossing sheet section is transferred from the sheet web and glued onto the material web or the remaining sheet backing is removed from the glued section. During or after gluing, a pattern can be embossed into the surface of the sheet. These machines can also be used to apply holograms onto material webs wherein, in particular, the temperature of the embossing tool and of the embossing sheet should be precisely regulated and the tension of the embossing sheet must be exactly controlled to prevent destruction of the hologram.

The embossing sheet advance, which is usually also an endless sheet, must be exactly controlled for exact positioning of the embossing sheet sections and for minimizing embossing sheet waste. The embossing sheet advance is usually less than the transport speed of the material web. The location where the embossing sheet section is applied must correspond to the imprint in the material web. Finally, for holograms, the section of the embossing sheet to be embossed must be precisely oriented relative to the embossing stamp to prevent destruction of the hologram, to transfer it into the correct position, and to fix it on the material web.

Conventional rotary embossing machines have the associated problem that the transport speed of the embossing sheet is adjusted in order to minimize waste. This is associated with a relatively large degree of effort.

It is therefore the underlying purpose of the invention to provide a rotary embossing machine with which the embossing sheet and also the material web are treated with great care, wherein the transport speed of the embossing sheet can be adjusted in a simple fashion.

SUMMARY OF THE INVENTION

This object is achieved with a rotary embossing machine having the features of the independent claim. Advantageous further developments can be extracted from the dependent claims.

The inventive rotary embossing machine ensures that the material web and also the embossing sheet provided as an endless web are transported only in one direction and do not exert any back and forth motion, i.e. the transport direction does not change. The embossing device, which rotates in a direction opposite to that of the counter pressure cylinder, contains at least one embossing unit with each embossing unit having its own complete supply of embossing sheet for that embossing unit. The embossing sheet is transported by a transport means provided in the embossing unit such that a new embossing sheet section is continuously supplied while minimizing sheet waste. This can be effected in a gentle fashion through slow advance.

The rotary motion of the embossing device imparts a speed to the embossing sheet section which corresponds to that of the material web such that the section can be easily transferred from the embossing tool to the material web. Directly after transfer of the embossing sheet section, the embossing sheet is gently further transported and a new embossing sheet section is provided. It is important that the embossing device precisely matches the speed of the embossing sheet to the speed of the material web. The embossing sheet itself is at rest in the embossing device during the embossing process.

Further advantages, features and details of the invention can be extracted from the following detailed description of three particularly preferred embodiments with reference to the drawing. The features shown in the drawing and disclosed in the description and the claims may be essential to the invention either individually or in any arbitrary combination.

DESCRIPTION OF THE PREFERRED EMBODIMENT

Figure 1:
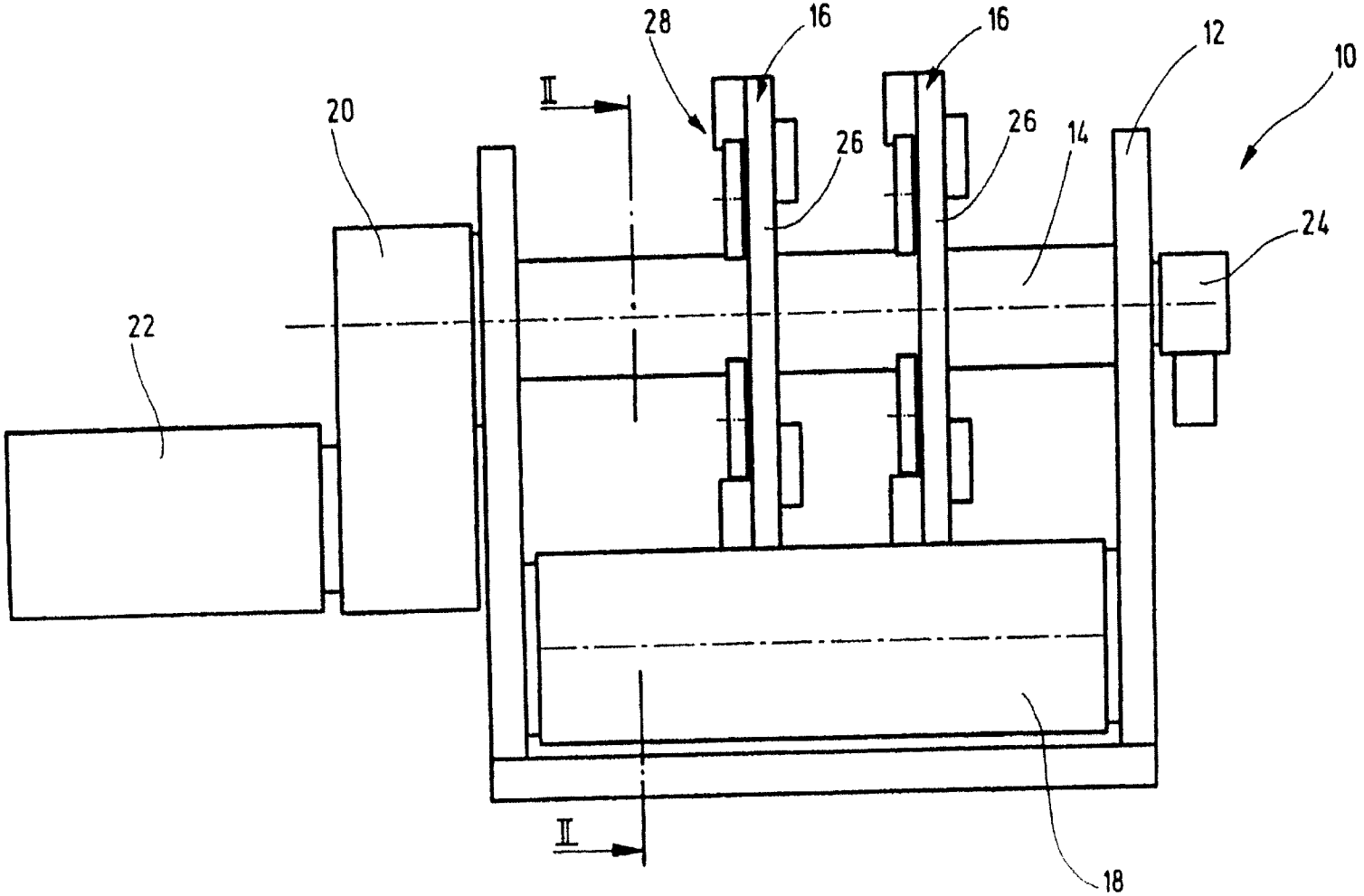
FIG. 1 shows a side view of the inventive rotary embossing machine.

FIG. 1 shows a rotary embossing machine, referred to in its entirety with 10, comprising a machine tool table 12 supporting a rotatably disposed drive shaft 14 for two embossing devices 16, and with a counter pressure cylinder 18. The drive shaft 14 is coupled to a transmission 20 and a drive 22. The other end of the drive shaft 14, which is hollow, is provided with a suctioning device 24 for suctioning e.g. a waste sheet (described in more detail below). The drive 22 of the embossing device 16 may be discontinuous.

Figure 2:
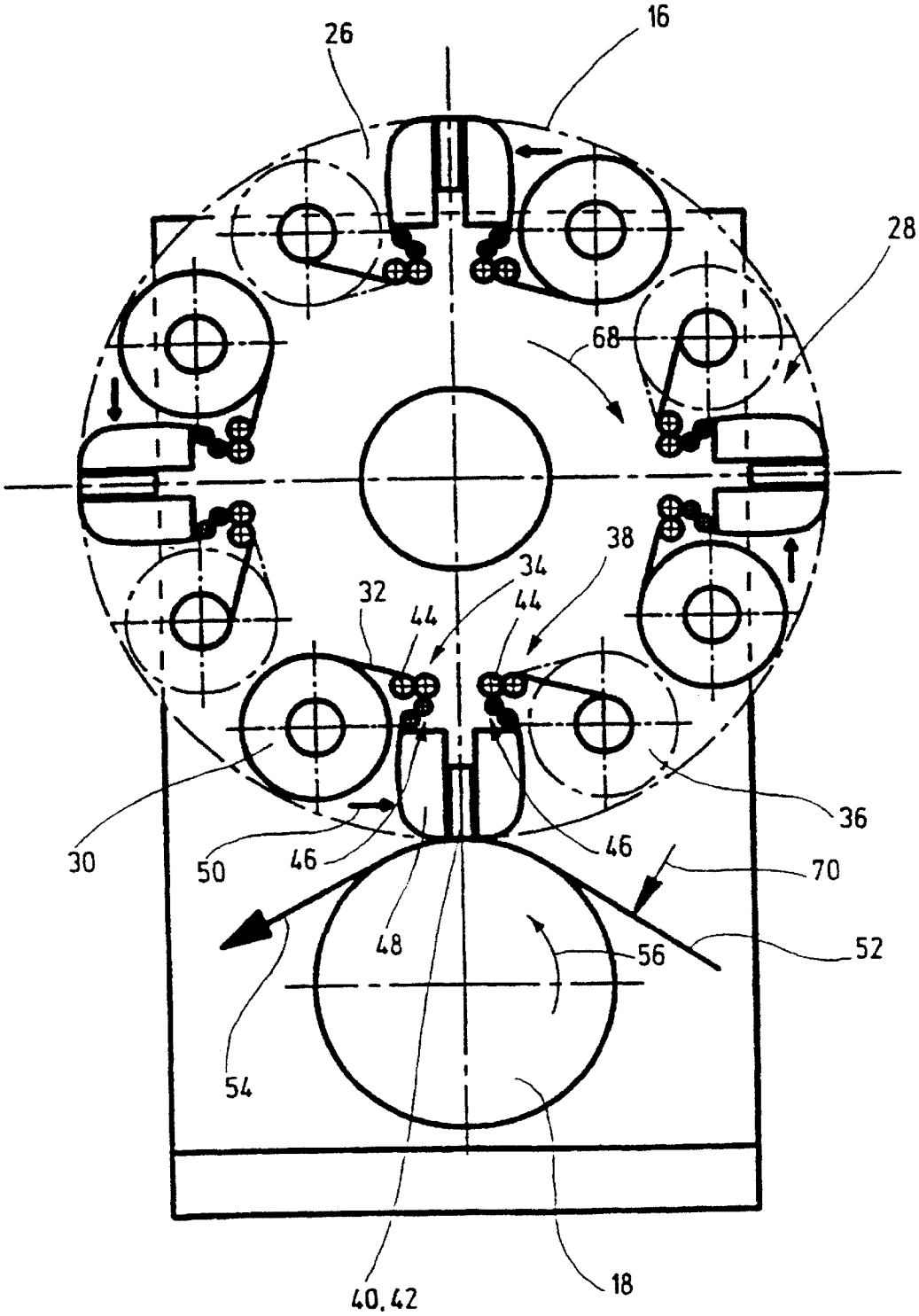
FIG. 2 shows a section II—II in accordance with FIG. 1, of a first embodiment of an embossing device.

FIG. 2 shows a section II—II in accordance with FIG. 1 of a first embodiment of the embossing device 16 which rotates in the direction of arrow 68. The embossing device 16 comprises a disc-shaped support 26 with a total of four embossing units 28. The embossing units 28 are mutually offset by angles of 900 and uniformly distributed about the periphery. Each embossing unit 28 has a supply roller 30 for an embossing sheet 32 which is stored as an endless web on this supply roller 30. The embossing sheet 32 is removed from the supply roller 30 by a first transport means 34 and is transported in the direction of a take-up roller 36. A further transport means 38 is provided before the take-up roller 36 which ensures easy transport of the embossing sheet 32 about an embossing tool 40.

The embossing tool 40 is an embossing stamp 42 which is disposed for displacement towards and away from the counter pressure cylinder 18. The two transport means 34 and 38 each have a traction station 44 formed by two rollers and a device 46 for keeping the tension on the embossing sheet 32 constant. This device 46 comprises e.g. spring-loaded rollers which apply a constant tension on the embossing sheet 32.

A heating shoe 48 is located between the transport means 34 and the embossing stamp 42 and heats the embossing sheet 32 to a temperature of e.g. between 80° and 120° C. Moreover, a sensor 50 is located in the region of the heating shoe 48 or generally before the embossing stamp 42 which scans a registration mark of the embossing sheet 32 in an optical, electronic, magnetic or contacting fashion and which controls the transport means 34 and optionally the transport means 38.

The embossing stamp 42 can also be heatable and the counter pressure cylinder 18 can be heatable or coolable. The transport direction of the material web 52 is indicated by arrow 54. The counter pressure cylinder 18 rotates correspondingly in the direction of the arrow 56. The transport direction of the embossing sheet 32 is therefore opposite to the transport direction 54 of the material web 52.

The embossing devices 16 can be displaced and adjusted on the drive shaft 14 in the longitudinal direction thereof. This permits processing of different material webs 52 or of different locations on material webs 52. Moreover, the drive shaft 14 can be easily provided with additional embossing devices 16 which are also fixed thereon for secure mutual rotation therewith.

The material web 52 passes a printer controller (indicated with arrow 70) upstream of the embossing stamp 42. This printer mark control 70 or embossing control detects registration marks on the material web 52 and controls the embossing stamp 42 and optionally the transport means 34 and 38.

Figure 3:
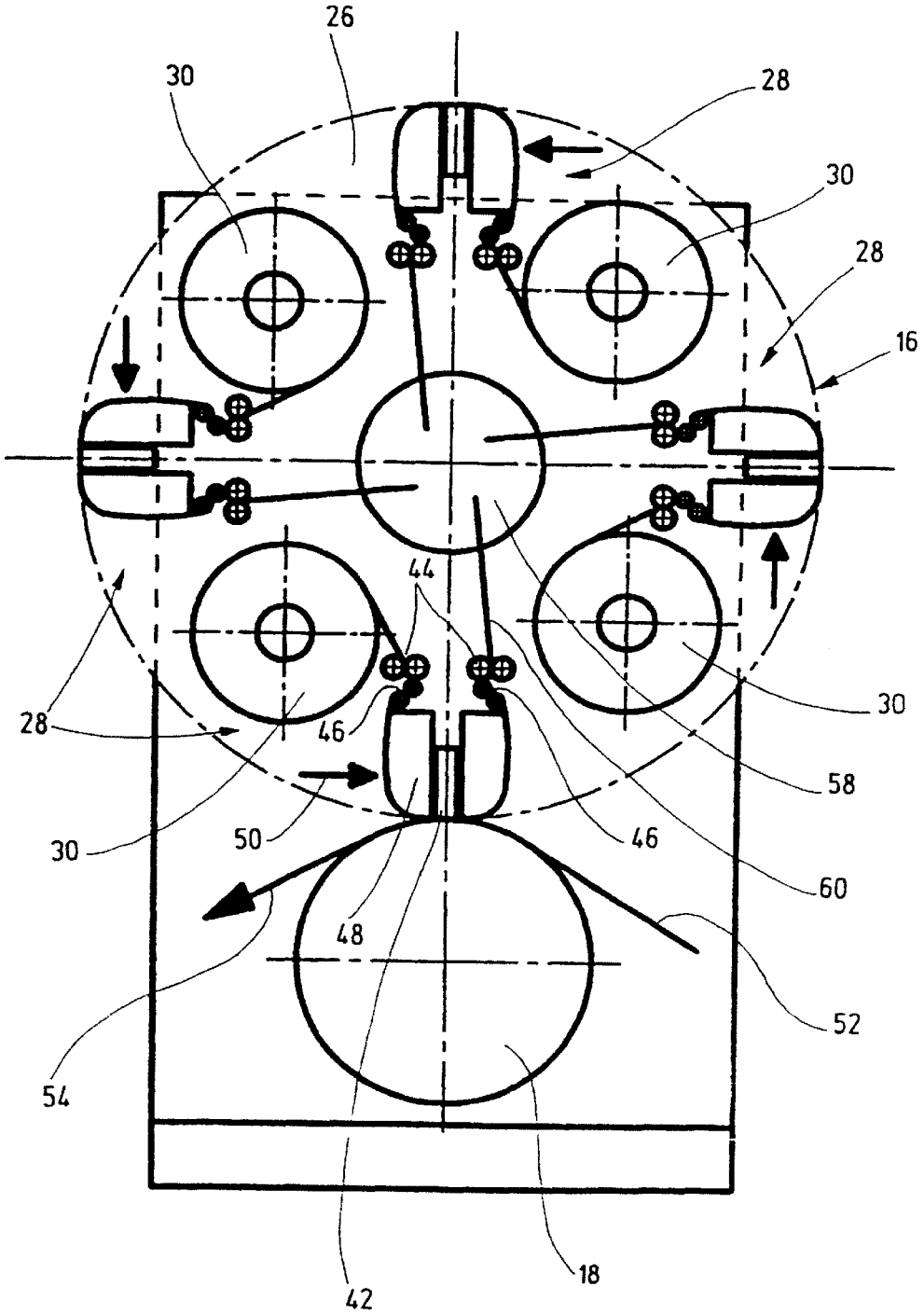
FIG. 3 shows a section II—II in accordance with FIG. 1 of a second embodiment of an embossing device.

In the embodiment of FIG. 3, a central disposal means 58 is provided instead of a take-up roller 36 into which the waste sheet 60 of each embossing unit 28 is suctioned and removed via the hollow drive shaft 14 and the suction device 24. This embodiment advantageously reduces the mass of the embossing device 16 and the embossing units 28 can be provided with larger supply rollers 30.

Figure 4:
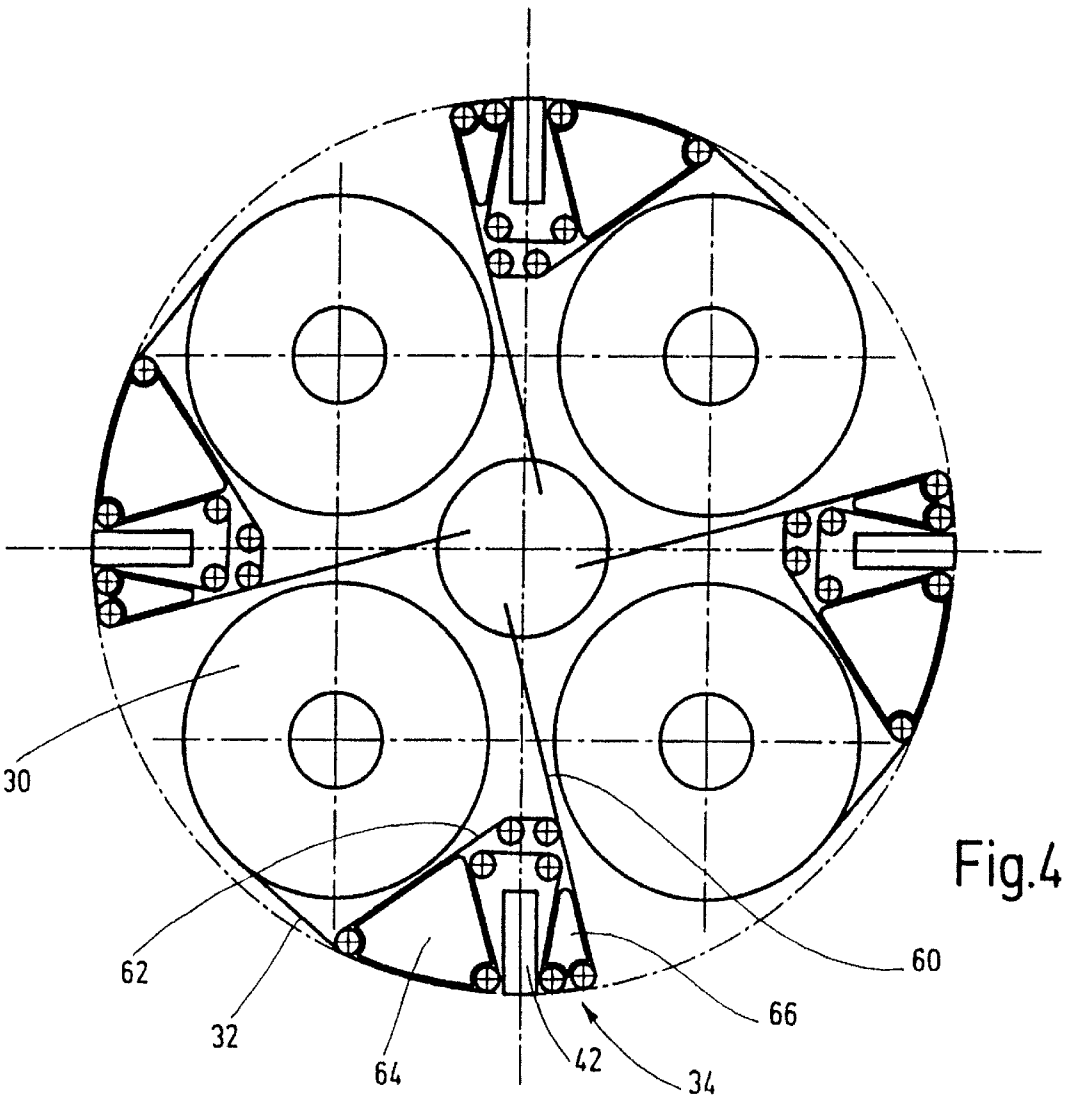
FIG. 4 shows a section II—II in accordance with FIG. 1 of a third embodiment of an embossing device.

In the embodiment of FIG. 4 of an embossing device 16 which also has four embossing units 28, the drive of the embossing sheet 32 is realized via a transport band 62, in particular a vacuum transport band with the vacuum being provided by vacuum chambers 64 and 66. Moreover, vacuum chamber 64 has a heating means for pre-heating the embossing sheet 32. The waste sheet 60 is also centrally suctioned.

Transfer of electrical energy and of data to the embossing devices 16 is effected either through slip rings or contract-free through a telemetry transfer means e.g. from the machine tool table 12 to the drive shaft 14.

I claim:

1. A rotary embossing machine for applying an embossing sheet section onto a material web, the embossing machine comprising:

a rotating counter pressure cylinder; and at least one embossing device rotating in a direction opposite to that of said counter pressure cylinder, said embossing device having at least one embossing unit rotating along with the embossing device, the embossing unit having a mutually rotating supply roller for the embossing sheet, at least one mutually rotating transport means for the embossing sheet, and a mutually rotating embossing tool.

2. The rotary embossing machine of claim 1, wherein said embossing device comprises an embossing disc with at least one embossing unit distributed about a periphery thereof.

3. The rotary embossing machine of claim 1, further comprising a plurality of embossing devices disposed on a common drive shaft.

4. The rotary embossing of claim 3, wherein said drive shaft is hollow.

5. The rotary embossing machine of claim 3, wherein said embossing devices are separated from each other and have adjustable axial positions on said drive shaft.

6. The rotary embossing machine of claim 1, wherein said embossing unit is mounted on said embossing device in one of a rigid fashion, a movable fashion, a rotatable fashion, and a pivotal fashion.

7. The rotary embossing machine of claim 1, wherein said embossing unit comprises a heating means for the embossing sheet.

8. The rotary embossing machine of claim 1, wherein said embossing tool is heated.

9. The rotary embossing machine of claim 1, wherein said embossing tool is an embossing stamp.

10. The rotary embossing machine of claim 9, wherein said embossing stamp can be displaced.

11. The rotary embossing machine of claim 1, wherein said embossing unit comprises a vacuum holding means for the embossing sheet.

12. The rotary embossing machine of claim 1, wherein said transport means comprises two tensioning means, disposed on either side of said embossing tool.

13. The rotary embossing machine of claim 1, wherein said transport means comprises means for keeping a tension of the embossing sheet constant.

14. The rotary embossing machine of claim 1, wherein said counter pressure cylinder can be at least one of heated and cooled.

15. The rotary embossing machine of claim 1, wherein said embossing unit comprises a register control for the embossing sheet.

16. The rotary embossing machine of claim 15, wherein said register control comprises a sensor for register marks on the embossing sheet.

17. The rotary embossing machine of claim 1, wherein said embossing unit comprises a take-up reel means for a waste sheet.

18. The rotary embossing machine of claim 1, wherein said embossing device comprises a disposing means for a waste sheet of said at least one embossing unit.

19. The rotary embossing machine of claim 18, wherein said disposing means is a suctioning means.

20. The rotary embossing machine of claim 1, wherein said embossing device has a discontinuous drive.

21. The rotary embossing machine of claim 20, wherein said drive comprises at least one of a printer mark control and a web sensor for the material web.

22. The rotary embossing machine of claim 1, wherein said transport means for the embossing sheet is one of a vacuum transport means and a vacuum transport band.

23. The rotary embossing machine of claim 1, wherein a transport direction of the embossing sheet is opposite to a transport direction of the material web.

24. The rotary embossing machine of claim 1, wherein the embossing sheet is at rest in said embossing unit during an embossing process.

* * * * *